US005964960A

United States Patent [19]

Boeck

[11] Patent Number: 5,964,960

[45] Date of Patent: Oct. 12, 1999

[54] CLEANING DEVICE

[75] Inventor: Karl Josef Boeck, Heidenheim, Germany

[73] Assignee: Voith Sulzer Papiermaschinen GmbH, Heidenheim, Germany

[21] Appl. No.: 08/879,138

[22] Filed: Jun. 19, 1997

[30] Foreign Application Priority Data

Jul. 11, 1996 [DE] Germany ..... 196 27 973

[51] Int. Cl.[6] ..... B08B 3/00; D21F 1/00; D21G 3/00

[52] U.S. Cl. ..... 134/34; 134/18; 134/21; 134/32; 134/33; 134/42; 134/95.2; 134/95.3; 134/103.2; 134/172; 134/198; 162/199; 162/272; 162/275; 162/278; 162/279

[58] Field of Search ..... 134/17, 18, 21, 134/32, 33, 34, 42, 61, 95.2, 95.3, 103.2, 172, 198; 162/272, 275, 278, 279, 199

[56] References Cited

U.S. PATENT DOCUMENTS

| | | | |
|---|---|---|---|
| 3,177,799 | 4/1965 | Justus et al. . | |
| 3,617,441 | 11/1971 | Farrell | 162/199 |
| 3,830,691 | 8/1974 | Truesdale et al. | 162/273 |
| 4,087,320 | 5/1978 | Danahy et al. | 162/252 |
| 4,167,440 | 9/1979 | Falk | 162/277 |
| 5,021,124 | 6/1991 | Turtinen et al. . | |
| 5,032,229 | 7/1991 | Boucher | 162/281 |
| 5,328,511 | 7/1994 | Beisswanger | 118/203 |
| 5,573,644 | 11/1996 | Poikolainen et al. | 162/278 |
| 5,651,832 | 7/1997 | Ahvenniemi et al. | 134/21 |
| 5,783,044 | 7/1998 | Schneider et al. | 162/278 |

FOREIGN PATENT DOCUMENTS

| | | |
|---|---|---|
| 385297 | 8/1987 | Australia . |
| 2680987 | 3/1993 | France . |
| 3641954 | 7/1987 | Germany . |
| 3929561 | 8/1990 | Germany . |
| 9015554 | 3/1991 | Germany . |
| 4123496 | 6/1992 | Germany . |
| 29517859 | 2/1996 | Germany . |
| 19522525 | 4/1996 | Germany . |
| 6-346393 | 12/1994 | Japan . |
| 91/18146 | 11/1991 | WIPO . |
| 94/12349 | 6/1994 | WIPO . |

OTHER PUBLICATIONS

Firm Publication of Paul Hammelmann Maschinenfabrik, entitled "Ruck Zuck, Hydrodnamische Reinigung" (1973).

Hammelmann, "Hochleistungsspritzrohre helfen Wasser sparen", *Sonderdruck aus dem Wochenblatt fur Papierfabrikation,* 98, Nr. 2, pp. 74–76 (1970).

Paikert, "Automatisch gesteuerte Hochdruckspritzrohre", *Wochenblatt fur Papierfabrikation,* 5, pp. 160,162 (1965).

*Primary Examiner*—Arlen Soderquist

*Attorney, Agent, or Firm*—Greenblum & Bernstein, P.L.C.

[57] ABSTRACT

Cleaning device to clean a roll, e.g., a concrete or granite roll, in a paper machine. The cleaning device may include a spray unit that may include a high-pressure spray device having an operational pressure of at least approximately 10 bar to spray a surface of the roll with a cleaning agent and a device to remove the cleaning agent from the roll surface.

28 Claims, 3 Drawing Sheets

CLEANING DEVICE

CROSS-REFERENCE TO RELATED APPLICATION

The present application claims the priority under 35 U.S.C. § 119 of German Patent Application No. 196 27 973.9, filed on Jul. 11, 1996, the disclosure of which is incorporated by reference herein in its entirety.

BACKGROUND OF THE INVENTION

1. Field of Invention

The present invention relates to a cleaning device for cleaning a roll in a paper machine. The cleaning device may include a spray unit for spraying the roll with a cleaning agent and a device for removing the cleaning agent from the roll surface.

2. Background and Material Information

In a paper machine, numerous rolls are used that come into contact with the paper sheet or web being produced. In the course of operating the paper machine, these rolls become fouled with, e.g., paper fibers, adhesives, or other additives associated with the web production process. When ceramic rolls are utilized, the pores in the roll surface can become clogged with loading material, e.g., calcium carbonate.

Thus, rolls of this type must be continuously cleaned during operation to eliminate the above-noted drawbacks. In the prior art, the continuous cleaning generally is performed by two sequentially arranged scrapers having a fluid sprayed onto the outer roll surface between the scrapers. However, cleaning units of this type have often been insufficient in operation.

SUMMARY OF THE INVENTION

A purpose of the present invention may be to provide a cleaning device for cleaning a paper machine roll that achieves a better cleaning effect, even in situations with heavy fouling on the roll, without suffering from the above-noted drawbacks of the prior art.

This purpose may be accomplished in accordance with the features of the present invention in which a spray unit of the cleaning device may include a high-pressure spray unit having an operating pressure of at least 10 bar.

In accordance with the present invention, a significantly improved cleaning effect may be achieved in the high-pressure spray unit design. It is noted that, according to prior art devices, it is insufficient to merely spray the roll surface to dissolve more-strongly-adhered contaminants or crusting. Thus, the present invention may utilize operating pressures greater than at least 10 bar to dissolve any heavy contamination that may be removed by a subsequent device, e.g., a scraper.

A particularly advantageous feature of the present invention includes cleaning smooth rolls, e.g., ceramic or granite rolls, that may be susceptible to contamination by, e.g., deposition of calcium carbonate.

The high-pressure spray device may include one of a needle jet nozzle and at least one high-pressure rotation jet.

In an alternative embodiment, the high-pressure spray device may include at least one needle jet nozzle arranged parallel to a longitudinal axis of the roll and includes a plurality of high-pressure needle jets distributed along a length of the roll. Thus, an even distribution of high-pressure needle jets may be provided along a roll surface, thus, ensuring even cleaning of the roll.

In another alternative embodiment of the present invention, the high-pressure spray device may include at least one needle jet nozzle having a plurality of high-pressure needle jets sequentially arranged in a direction of rotation of the roll. The needle jet nozzle may be arranged on a traverse glide that traverses back and forth along a longitudinal direction of the roll. In this manner, a wide-spread cleaning effect may be achieved so that an entire roll surface may be cleaned with relatively few high-pressure needle jets.

The needle jet nozzle may be operated with a pressure of, e.g., at least approximately 40 bar to achieve a particularly intensive cleaning effect. According to additional embodiments of the present invention, the high-pressure spray device may include at least one rotation jet unit operated with an operational pressure of, e.g., at least approximately 50 bar, and, preferably, with an operational pressure of, e.g., between approximately 100 to 250 bar.

An improved cleaning effect may be achieved with the rotation spray jet unit. Since the jet may be angled to direct the stream at the roll surface at high pressure, the present invention may be particularly suited for dissolving firmly adhered encrustation on the roll surface.

In a further embodiment of the present invention, at least one rotation jet device may be surrounded by a suction globe, may be open to the roll surface, and may be under a vacuum.

With a combination of a cleaning jet unit and a suction globe, the contamination dissolved by the jet stream may be immediately sucked out, and, in a quickest possible manner, may be removed together with any remaining water vapor or residues of the cleaning fluid. Thus, the present invention provides a compact and integral structural arrangement through the jet and suction device combination.

On an open side directed toward the roll surface, the suction globe may be fitted to the shape of the surface of the roll and may be sealed to the surface of the roll by one of an elastic casing and a brush frame. In this manner, a particularly effective suction effect may be created to further improve the entire cleaning effect.

In another preferred embodiment, the rotation jet unit may exhibit a rotational axis that may be angled relative to a surface normal of the roll surface. In addition to, or in the alternative, the rotation jet device may include a nozzle cap having at least one cleaning jet angled relative to the rotational axis of the rotation jet unit.

With the above-noted features, an improved cleaning effect may be achieved because the jet stream can better dissolve the contaminants that adhere to the roll surface. This improved cleaning effect may be due to a cleaning impulse created by rotation of the jets striking the roll surface from different directions. In accordance with the present invention, the cleaning effect is most effective in the rotational area, i.e., where the cleaning jet (stream) may exhibit velocity components having a rotational direction opposite that of the roll.

This effect may be further exploited by deactivating, through hydraulic techniques, the jet stream in the area in which it basically exits in the rotational direction of the roll. Accordingly, a screen may be designed to prevent the striking of the jet streams. Alternatively, with regard to economical water usage, sections of pressurizable jet supply feeder lines may be designed.

In another preferred embodiment of the present invention, the rotation jet unit may include a jet cap having at least one jet with a nozzle diameter of, e.g., approximately 0.1 mm to 0.8 mm, and preferably, e.g., approximately 0.2 mm to 0.4 mm.

In this manner, a good compromise may be achieved between water consumption and cleaning agent used, and the cleaning effect.

According to another embodiment of the present invention, a plurality of rotation jet units may be arranged in front of the roll surface over an entire roll width. In this arrangement, a simultaneous cleaning of the roll, i.e., over its entire surface, may be possible.

In an alternative embodiment of the present invention, at least one rotation jet unit may be mounted on a traverse glide that traverses back and forth in the longitudinal direction of the roll. This feature provides the added advantage that the additional overlap with the velocity components of the traverse glide, i.e., moving back and forth, may create an additional intensification of the cleaning effect. Further, fewer rotation jet units may be required to clean the entire roll surface, thus, minimizing the consumption of cleaning fluids.

In another embodiment of the present invention, a rinsing device may be arranged subsequent to the high-pressure spray unit in the rotational direction of the roll and may be supplied with a larger fluid volume than the high-pressure spray unit to rinse the roll surface. This arrangement may provide a flotation of dissolved contaminants by the high-pressure spray unit, which may be either a needle jet nozzle or rotation jet unit, and may facilitate their removal from the roll surface.

The rinse device may be designed, e.g., as a fan jet nozzle extending parallel to the roll surface along the longitudinal direction of the roll.

In another alternative of the present invention, at least one scraper may be placed, i.e., when viewed in the rotational direction of the roll, to precede the high-pressure spray unit. Further, for preferably removing the cleaning agents, the unit may include a scraper arranged to follow the high-pressure spray unit roll behind the rinsing unit, i.e., when viewed in the rotational direction of the roll. This arrangement provides a condition in which the loosely adhered coarse contaminants may be removed by the scraper placed ahead in the rotational direction of the roll, and the following scraper removes the residual moisture from the roll surface to avoid wet streaks on the roll and, consequently, on the paper sheet.

In accordance with the present invention, it is contemplated that several scrapers may be placed in front and/or behind the high-pressure spray unit. It is likewise conceivable that the above-noted features of the present invention, as well as the features explained below, may be utilized, not only in the prescribed combinations, but also in other combinations or separately without departing from the scope of the invention.

The present invention may be directed to a cleaning device to clean a roll in a paper machine. The cleaning device may include a spray unit that may include a high-pressure spray device having an operational pressure of at least approximately 10 bar to spray a surface of the roll with a cleaning agent and a device to remove the cleaning agent from the roll surface.

According to another feature of the present invention, the high-pressure spray device may include at least one needle jet nozzle arranged parallel to a longitudinal axis of the roll, and a plurality of high-pressure jets spaced over a longitudinal direction of the roll.

According to another feature of the present invention, the high-pressure spray device may include at least one needle jet nozzle having a plurality of high-pressure jets arranged in a rotational direction of the roll. The cleaning device may further include a traverse glide that traverses back and forth in the longitudinal direction of the roll and the high-pressure spray device may be mounted to the traverse glide.

According to still another feature of the present invention, the high-pressure spray device may include at least one rotation jet unit having an operating pressure of at least approximately 50 bar. Further, the operating pressure may be between approximately 100 and 250 bar.

According to a further feature of the present invention, the cleaning device may include a suction globe that encloses the at least one rotation jet unit, that is open to the roll surface, and that is under a vacuum. Further, the suction globe may include an elastic casing or a brush frame.

According to a still further feature of the present invention, the rotation jet unit may include a rotation axis that is positioned to be angled with respect to a surface normal of the roll surface.

According to yet another feature of the present invention, the rotation jet unit may include a jet cap having at least one cleaning jet that may be angled in a direction against the rotational axis of the rotation jet unit.

According to still another feature of the present invention, the rotation jet unit may include a jet cap having at least one cleaning jet with a jet diameter of between approximately 0.1 mm and 0.8 mm. Further, the jet diameter may be between approximately 0.2 mm and 0.4 mm.

According to a further feature of the present invention, a plurality of rotational jet units may be spaced in front of the roll surface along the width of the roll.

According to another feature of the present invention, the cleaning device may also include a traverse glide that traverses back and forth along a longitudinal direction of the roll and at least one of the plurality of rotation jet units may be mounted on the traverse glide.

According to yet another feature of the present invention, the cleaning device may further include a rinsing unit arranged downstream of the high-pressure spray device in a rotational direction of the roll. The rinsing unit may be supplied with a larger amount of fluid than the high-pressure device to rinse the roll surface. Further, the rinsing unit may include a fan jet nozzle extending parallel to the roll surface along a longitudinal direction of the roll. Still further, the device to remove the cleaning agent may include at least one scraper arranged downstream of one of the high-pressure spray device and rinsing unit in the rotational direction of the roll.

According to another feature of the present invention, the cleaning device may also include at least one scraper arranged upstream of the high-pressure spray device in a rotational direction of the roll.

According to still another feature of the present invention, the operational pressure may be at least approximately 40 bar.

According to yet another feature of the present invention, the roll may include one of a granite and ceramic roll.

The present invention may also be directed to a method of using a cleaning device to clean an outer surface of a roll in a web production machine. The cleaning device may include a high-pressure spray device to spray a surface of the roll with a cleaning agent and a device to remove the cleaning agent from the roll surface. The method may include positioning the high-pressure spray device adjacent the outer surface of the roll to be cleaned, directing the high-pressure spray device toward the surface of the roll, and spraying the roll with cleaning fluid at an operational pressure of at least approximately 10 bar.

According to another feature of the present invention, the spraying of the roll may include simultaneously spraying a plurality of jets along a longitudinal portion of the roll. Further, the longitudinal portion may include an entire length of the roll. Alternatively, the method may include moving the plurality of jets substantially along an entire length of the roll. Further, the method may include rotating the plurality of jets around a rotational axis and moving the rotational axis substantially along the entire length of the roll.

According to still another feature of the present invention, the spraying of the roll may include simultaneously spraying a plurality of jets along a circumferential portion of the roll. The method may further include moving the plurality of jets substantially along an entire length of the roll.

According to a further feature of the present invention, the method may also include first scraping the outer surface of the roll before spraying the roll and second scraping the outer surface of the roll after spraying the roll. The method may further include rinsing the outer surface after spraying the roll, and the rinsing may include expelling a greater amount of cleaning fluid than the spraying. Still further, the second scraping may remove remaining moisture on the outer surface of the roll.

According to yet another feature of the present invention, the method may also include suctioning at least one of loosened and removed contaminates from the outer surface of the roll.

Other exemplary embodiments and advantages of the present invention may be ascertained by reviewing the present disclosure and the accompanying drawing figures.

BRIEF DESCRIPTION OF DRAWINGS

The present invention may be further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENT

Figure 1:
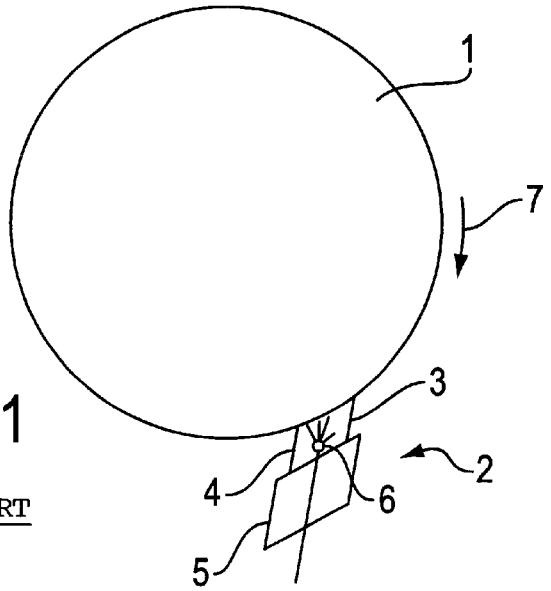
FIG. 1 PRIOR ART
FIG. 1 illustrates prior art cleaning device associated with a roll.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figures making apparent to those skilled in the art how the invention may be embodied in practice.

A roll 1 may be illustrated in FIG. 1 that is equipped with a cleaning device 2 in accordance with the prior art. In particular, roll 1 may be, e.g., a ceramic or granite roll that may be particularly susceptible to encrusting due to, e.g., calcium carbonate.

Cleaning device 2 contains a scraper beam 5 for mounting a spray unit 6 in a rotational direction 7 of roll 1. Spray unit 6 is used to spray roll 1 and is mounted between a scraper 3 that extends along an entire width of roll 1 and a second scraper 4 that likewise extends along the entire width of roll 1. Scrapers 3 and 4 are angled toward the rotational direction 7 of roll 1. The water sprayed onto roll 1 by spray unit 6 moisturizes the roll surface and partially dissolves contamination particles and second scraper 4 partially removes the remaining contamination particles. However, the cleaning device of the prior art generally does not ensure a sufficient cleaning, particularly when strongly adhered contaminants are present on the roll surface.

Figure 2:
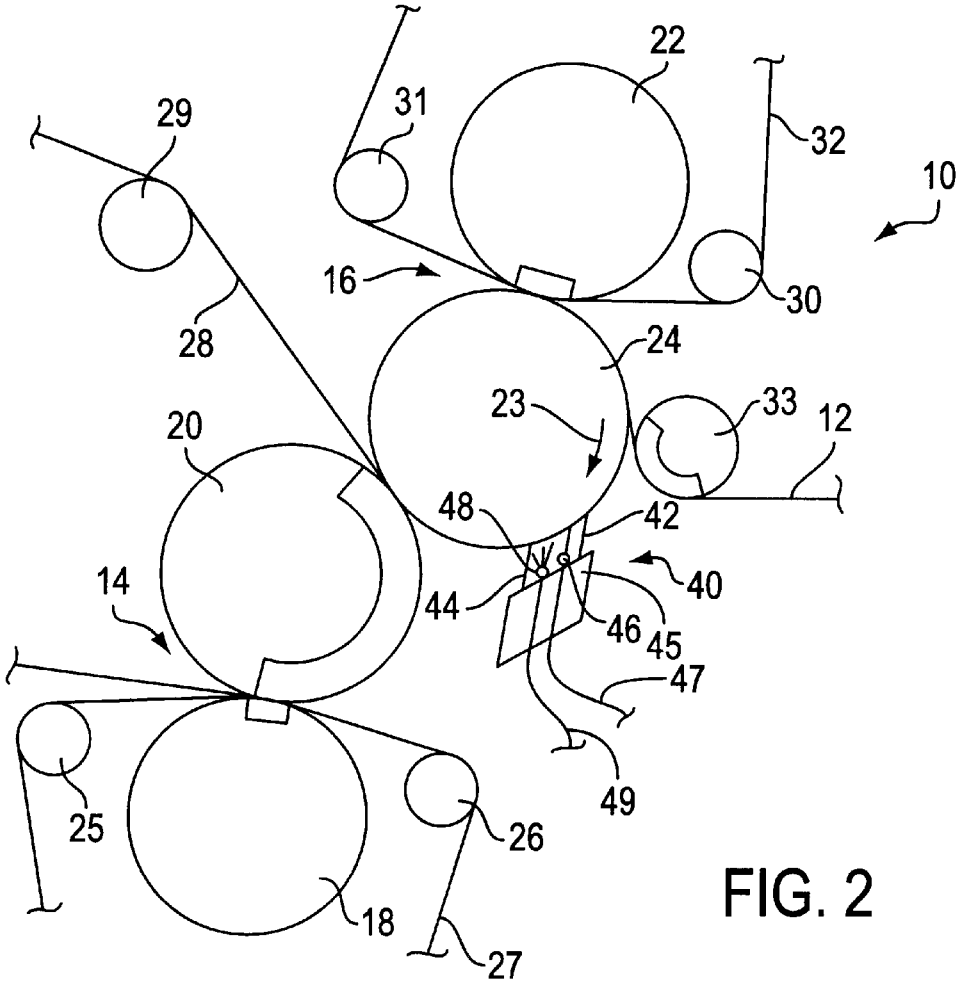
FIG. 2 illustrates an exemplary illustration of a cleaning device according to the present invention utilized in a section of a pressing unit in a paper-making machine.

FIG. 2 illustrates a press section 10 of a web producing machine, e.g., a paper-making machine. On a central roll 24 of press section 10, a cleaning device 40, in accordance with the present invention, may be positioned to remove contamination particles and web residues from the outer surface of roll 24.

A continuous web 12, e.g., a paper sheet, may be guided from a preceding portion of the web production machine, e.g., a sieve section (not illustrated), by a felt belt guided 28 over a plurality of deflection rolls. For the sake of simplifying the description of the present invention, only deflection roll 29 and a suction roll 20 associated with this portion of the press section 10 are illustrated. However, the arrangement of the deflection rolls may be provided by the ordinarily skilled artisan in any conventional manner of the prior art. Suction roll 20 may be arranged adjacent a shoe press roll 18 to form a press nip. A lower press felt 27 may be guided through the press nip formed between shoe press roll 18 and suction roll 20 with web 12 and felt belt 28 such that web 12 is guided between felt belt 28 and lower press felt 27. Lower press felt 27 may be guided by a plurality of deflection rolls (including deflection rolls 25 and 26), which may be arranged in any conventional manner.

Web 12 may be transferred from suction roll 20 to smooth central roll 24, e.g., a ceramic or granite roll, at a transfer point 15. A second press nip 16 may be formed between a shoe press roll 22 and central roll 24. Web 12 may be guided through second nip 16 with a top felt 32. Top felt 32 may be guided by a plurality of deflection rolls (including deflection rolls 30 and 31), which may be arranged in any conventional manner.

After leaving second press nip 16, web 12 may be lifted off or pulled from roll 24 by a suction roll 33 and either may be guided toward a subsequent press opening or may be directly transferred to a subsequent drying section.

Cleaning device 40 may be associated with central roll 24. Cleaning device 40 may include an initial scraper 42 mounted on a scraper beam 45 to abut an outer surface of central roll 24. Initial scraper 42 may be positioned at an angle against a rotational direction 23 of central roll 24 surface and may extend over an entire width of central roll 24 so as to provide an initial removal of residue on the surface of central roll 24. A needle jet spray nozzle 46 may be arranged to be oriented downstream of, with respect to the rotational direction 23, and parallel to scraper 42. Needle jet spray nozzle 46 may extend along the entire width of central roll 24 (described in greater detail in FIG. 3) and may be operated at a pressure of, e.g., at least approximately 10 bar, preferably with a pressure of, e.g., more than approximately 40 bar. Needle jet spray nozzle 46 may be utilized for intensive cleaning of central roll 24. Cleaning device may also include a rinsing unit located downstream of, with respect to rotational direction 23, needle jet spray nozzle 46. Rinsing unit may include, e.g., a fan jet nozzle 48 (shown with enhanced clarity in FIG. 3) extending parallel to the surface of roll 24 over the entire roll width. Fan jet nozzle 48 may be operated with a substantially higher throughput of cleaning fluid than amount of fluid exiting needle jet spray nozzle 46.

Fan jet nozzle 48 may cause a flotation of contamination particles dissolved by needle jet spray nozzle 46 to be removed from the surface of central roll 24 by a second scraper 44. Second scraper 44 may be arranged at an angle against the roll surface to ensure a dry roll surface and to prevent moisture streaking on web 12.

As discussed above and more clearly shown in FIG. 3, needle jet spray nozzle 46 may include a plurality of needle jets 50 oriented against the roll surface, e.g., at a slight angle with respect to rotational direction 23. Fan jet spray nozzle 48 may include a plurality of fan jets 52 oriented to spray cleaning fluid onto the roll surface.

Needle jet spray nozzle 46 may be supplied with cleaning fluid by a feeder line 47. Feeder line 47 may supply the cleaning fluid at a pressure of, e.g., at least approximately 10 bar, and preferably, e.g., more than approximately 40 bar. Fan jet spray nozzle 48 may be operated at a lower pressure than needle jet spray nozzle 46, however, fan jet spray nozzle 48 may have a substantially higher flow of cleaning fluid.

Water may be generally used as the cleaning agent/fluid. However, if desired, additives for improving the cleaning effect may be added to the cleaning fluid to be discharged through the needle jet spray nozzle 46.

Figure 3:
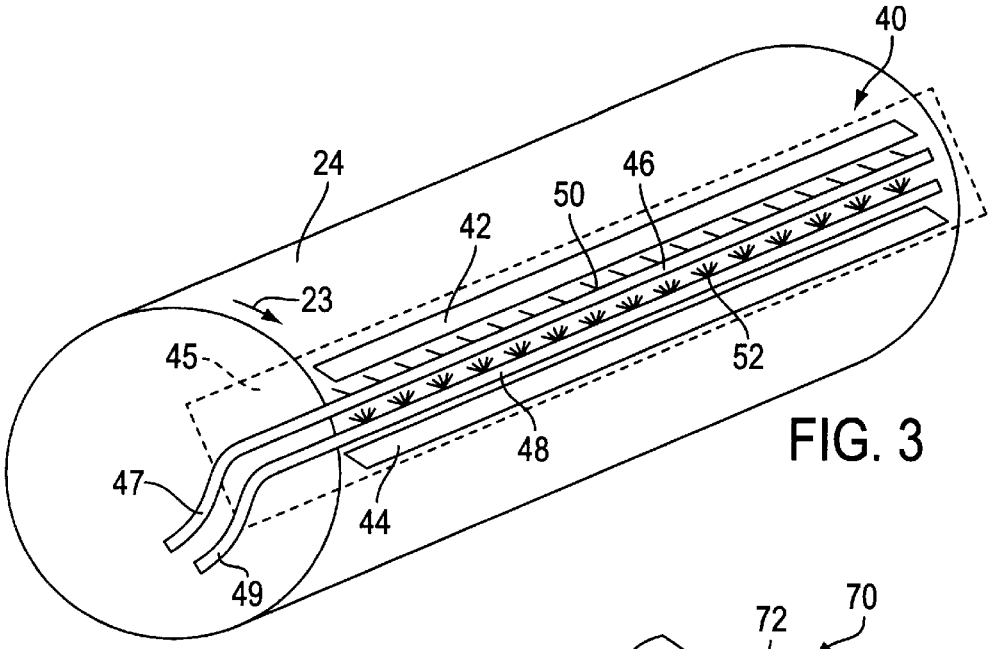
FIG. 3 illustrates a perspective view of the arrangement of the cleaning device and the roll depicted in FIG. 2.

It is understood that the embodiment depicted in FIGS. 2 and 3 are exemplary and presented for the purpose of explanation, and the invention should not be construed as limited by these illustrations.

Figure 4:
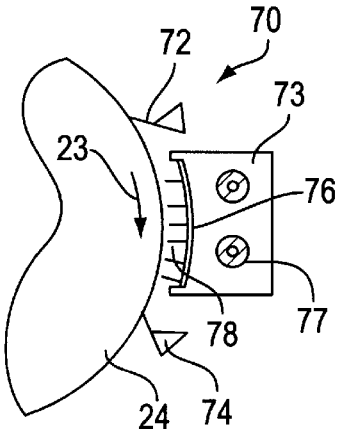
FIG. 4 illustrates a partial sectional view of another embodiment of a cleaning device roll with a cleaning device in accordance with the invention as a slightly modified form of FIG. 3.

In FIG. 4, a cleaning device 70 for cleaning central roll 24 may be positioned adjacent roll 23. Cleaning device 70 may include a needle jet spray nozzle 76 arranged in rotational direction 23 between a leading first scraper 72 and a following scraper 74.

In contrast to the embodiment depicted in FIGS. 2 and 3, needle jet spray nozzle 76 may be arranged to extend around a curved portion of the surface, i.e., along a circumferential extent of the surface, to be substantially parallel to, i.e., equidistantly spaced from the surface of, central roll 24. To clean central roll 24 over its entire width, needle jet spray nozzle 76 may be mounted on a movable traverse glide 71 in a direction perpendicular to rotational direction 23 of central roll 24, i.e., along the length of central roll 24. The traverse glide 71 may be guided parallel to the roll surface on cross beams 77 and may be driven by a traverse motor (not shown) with an adjustable speed. The traverse velocity of traverse glide 71 may be, e.g., approximately 0.3 m per minute.

An increased cleaning effect may occur through a combination of needle jet spray nozzle 76 with a plurality of jet nozzles 78 extending along the portion of the circumference of central roll 24 in rotational direction 23 and moving with a back-and-forth traverse movement. In this manner, the discharged spray jets may strike the roll surface at different angles.

Figure 5:
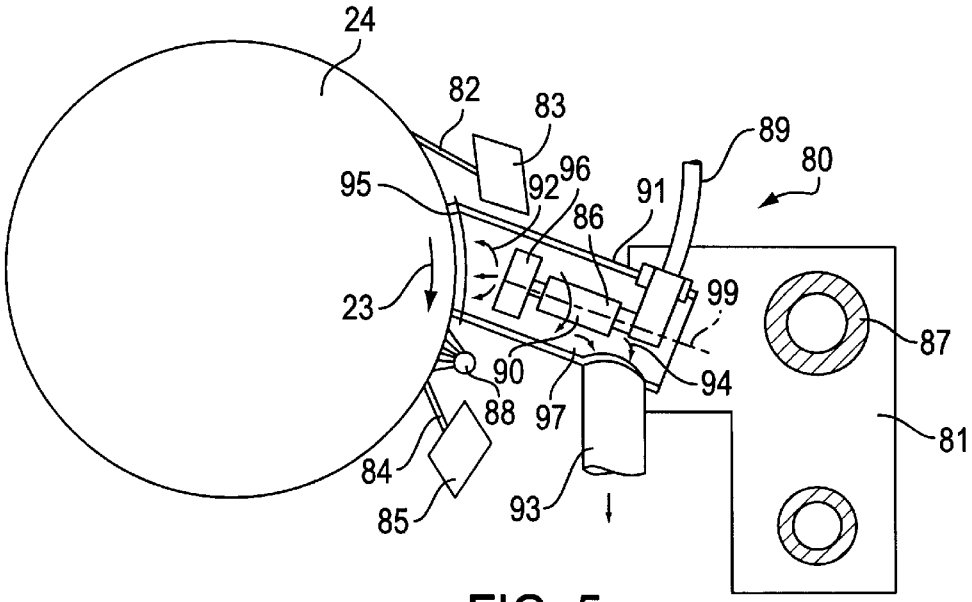
FIG. 5 illustrates an alternative embodiment of the cleaning device of the present invention having a rotation jet unit.

Another embodiment of the present invention may be illustrated in FIG. 5 in which a high-pressure jet device may include at least one rotation jet device. A cleaning device 80 may include a rotation jet device 86 combined with a suction globe 91 and a traverse glide 81. Traverse glide 81 may be utilized to move cleaning device 80 back and forth in a manner parallel to the roll surface over the entire width of the roll. Further, a fan jet nozzle 88 may be coupled to run parallel to the axial length of roll surface over the entire width of central roll 24.

A leading scraper 82 may be mounted on a scraper beam 83 arranged at an angle against the roll surface of central roll 24. Following fan jet nozzle 88, i.e., in rotational direction 23, a second scraper 84 may be mounted on a scraper beam 85 and placed against the roll surface, e.g., at an angle slightly against the rotational direction 23.

Rotation jet device 86 may be supplied through a high-pressure feeder line 89 at a water pressure in a range, e.g., between approximately 50 and 1,000 bar, and preferably in the range of, e.g., approximately 100 to 250 bar, and may include a jet cap 96 set into a rotational movement in the range of, e.g., 2,000 to 3,000 revolutions per minute with one or more tangentially discharging drive jets. Jet cap 96 may include one or more cleaning jets oriented toward the surface of central roll 24 to strike the roll surface with the cleaning agent.

An inside portion of suction globe 91 may be hydraulically coupled to a suction line 93 and may form a suction chamber 97 associated with rotation jet device 86. On a side open to the roll surface, suction globe 91 may be fitted to the surface of central roll 24 and may be sealed on the edges against the surface of central roll 24 by a brush frame 95 or an elastic casing.

Figure 6:
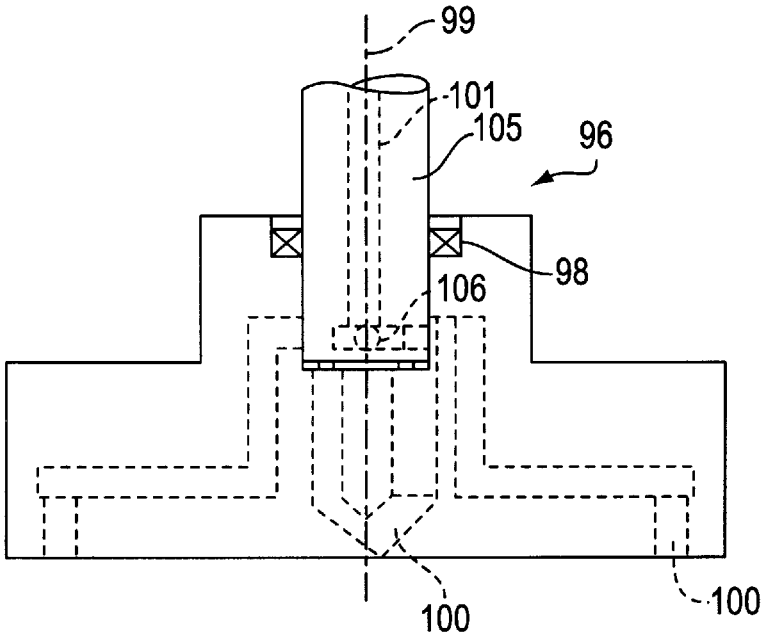
FIG. 6 illustrates a section through a jet cap utilized in the rotation jet nozzle device in accordance with the alternative embodiment depicted in FIG. 5.
Figure 7:
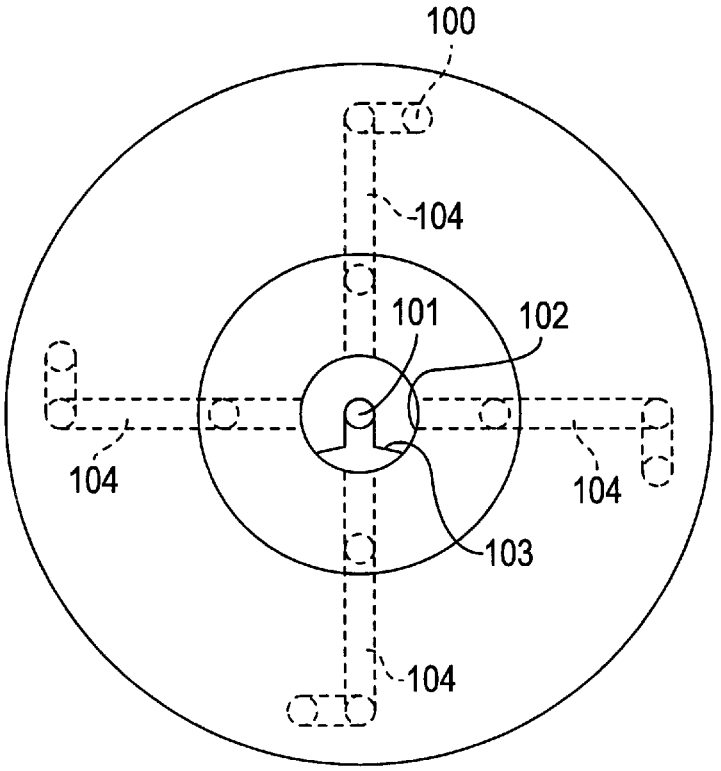
FIG. 7 illustrates a bottom view of the jet cap depicted in FIG. 6.

Rotation jet unit 86 may include a rotational axis 99 positioned at a slight angle, with respect to a surface normal, to the surface of central roll 24 and against rotational direction 23. As indicated by directional arrows 92, the high-pressure cleaning jets may be directed through jet cap 96, rotating quickly in a direction of an arrow 90, at various angles with respect to the surface of central roll 24. A particularly powerful cleaning effect may be achieved through a combination of the inclination of the rotational axis 99 and the back and forth movement of traverse glide 81. This powerful cleaning effect may be further enhanced with cleaning jets 100 formed on jet cap 96. Cleaning jets 100 may be inclined at an angle to rotational axis 99, as shown in FIGS. 6 and 7.

By the present arrangement, an extremely intense cleaning effect may be achieved. At the same time, an immediate suction and removal of the dissolved contamination particles through suction line 93 may be enabled by suction globe 91, as indicated by arrows 94.

The interaction of subsequent rinsing by fan jet nozzle 88 and follow-up scraper 84 provides an exceptionally thorough cleaning and subsequent drying of central roll 24.

The assembly of jet nozzle 96 may be more fully explained with reference to FIGS. 6 and 7. Nozzle cap 96 may be mounted on a flange 105 via a bearing 98. In an interior portion of flange 105, a stationary jet supply line 101 may be formed to terminate in a pressure chamber 106 having walls 103. Walls 103 may be sealed, but movable, against an interior portion of a cylinder-shaped component 102. Cylindrical component 102 may include, e.g., four openings set 90° from each other. Jet supply feeder lines 104 may radially extend from cylindrical component 102 to an exterior of jet nozzle 96 and may be bent in an end section preferably at 90°, as shown in FIG. 7. Jet supply feeder lines 104 may finally terminate in angled cleaning jets 100, as shown in FIG. 6. The drive jets, also included in the design, are not illustrated in the figures. As shown in FIGS. 6 and 7, only one jet supply line 104 may be pressurized while the remaining jet supply lines 104 may be depressurized. Pressure chamber 106 may be oriented so that fluid jet/spray provides a velocity component counter to rotational direction 23 of central roll 24, so that the cleaning effect may be particularly high. At the same time, the jets whose fluid spray would exhibit velocity components in rotational direction 23 of counter roll 24 may be depressurized and, therefore, deactivated to reduce the water consumption.

In an alternative to the previously described embodiment, jet cap 96 may be equipped with one or more single jets mounted in a pivotable position for an oscillating motion to sweep a band-shaped region of counter roll 24 during the traverse movement of jet nozzle 96.

It is understood that instead of one single rotation jet unit 86, several rotation jet units 86 of this type may be combined within a suction globe and may be moved together with traverse glide 81. It is further understood that in its place an entire row of high-pressure spray units 86 may be arranged adjacent to each other over the entire roll width so that a traverse glide would not be necessary.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A cleaning device to clean a roll in a paper machine comprising:

a roll;

a spray unit comprising a high-pressure spray device having an operational pressure of at least approximately 10 bar to spray a Surface of the roll to be cleaned with a cleaning agent;

a rinsing unit arranged downstream of the high-pressure spray device in a rotational direction of the roll; and a scraper device located downstream of the spray unit and the rinsing unit, relative to a rotational direction of the roll, to remove the cleaning agent from the roll surface.

2. The cleaning device according to claim 1, the high-pressure spray device comprising at least one needle jet nozzle arranged parallel to a longitudinal axis of the roll, and a plurality of high-pressure jets spaced over a longitudinal direction of the roll.

3. The cleaning device according to claim 1, the high-pressure spray device comprising at least one needle jet nozzle having a plurality of high-pressure jets arranged in a rotational direction of the roll;

the cleaning device further comprising a traverse glide that traverses back and forth in the longitudinal direction of the roll; and the high-pressure spray device being mounted to the traverse glide.

4. The cleaning device according to claim 1, the high-pressure spray device comprising at least one rotation jet unit having an operating pressure of at least approximately 50 bar.

5. The cleaning device according to claim 4, the operating pressure being between approximately 100 and 250 bar.

6. The cleaning device according to claim 4, further comprising a suction globe that encloses the at least one rotation jet unit, that is open to the roll surface, and that is under a vacuum.

7. The cleaning device according to claim 6, the suction globe comprising an elastic casing or a brush frame.

8. The cleaning device according to claim 4, the rotation jet unit comprising a rotation axis that is positioned to be angled with respect to a surface normal of the roll surface.

9. The cleaning device according to claim 4, wherein the rotation jet unit comprises a jet cap having at least one cleaning jet that is angled in a direction against the rotational axis of the rotation jet unit.

10. The cleaning device according to claim 4, the rotation jet unit comprising a jet cap having at least one cleaning jet with a jet diameter of between approximately 0.1 mm and 0.8 mm.

11. The cleaning device according to claim 10, the jet diameter being between approximately 0.2 mm and 0.4 mm.

12. The cleaning device according to claim 4, wherein a plurality of rotational jet units are spaced in front of the roll surface along the width of the roll.

13. The cleaning device according to claim 4, further comprising a traverse glide that traverses back and forth along a longitudinal direction of the roll; and at least one of the plurality of rotation jet units being mounted on the traverse glide.

14. The cleaning device according to claim 1, wherein the rinsing unit is supplied with a larger amount of fluid than the high-pressure device to rinse the roll surface.

15. The cleaning device according to claim 14, the rinsing unit comprising a fan jet nozzle extending parallel to the roll surface along a longitudinal direction of the roll.

16. The cleaning device according to claim 1, further comprising at least one scraper arranged upstream of the high-pressure spray device in a rotational direction of the roll.

17. The cleaning device according to claim 1, the operational pressure being at least approximately 40 bar.

18. The cleaning device according to claim 1, the roll comprising one of a granite and ceramic roll.

19. A method of using a cleaning device to clean an outer surface of a roll in a web production machine, the cleaning device including a high-pressure spray device and a scraper device to remove the cleaning agent from the roll surface, the method comprising:

positioning the high-pressure spray device adjacent the outer surface of the roll to be cleaned;

directing the high-pressure spray device toward the surface of the roll;

scraping the outer surface of the roll with a second scraper device before spraying the spraying the roll with a cleaning agent at an operational pressure of at least approximately 10 bar;

rinsing the outer surface after spraying the roll; and removing the cleaning agent with the scraper device, which is located downstream of the high-pressure spray device and the rinsing, relative to a rotational direction of the roll.

20. The method according to claim 19, the spraying of the roll comprising simultaneously spraying a plurality of jets along a longitudinal portion of the roll.

21. The method according to claim 20, the longitudinal portion comprising an entire length of the roll.

22. The method according to claim 20, further comprising moving the plurality of jets substantially along an entire length of the roll.

23. The method according to claim 22, further comprising rotating the plurality of jets around a rotational axis; and moving the rotational axis substantially along the entire length of the roll.

24. The method according to claim 19, the spraying of the roll comprising simultaneously spraying a plurality of jets along a circumferential portion of the roll.

25. The method according to claim 24, further comprising moving the plurality of jets substantially along an entire length of the roll.

26. The method according to claim 19, the rinsing comprising expelling a greater amount of cleaning agent than the spraying.

27. The method according to claim 19, the second scraping removing remaining moisture on the outer surface of the roll.

28. The method according to claim 19, further comprising suctioning at least one of loosened and removed contaminates from the outer surface of the roll.

* * * * *